United States Patent [19]

Vachhani

[11] Patent Number: 4,624,521

[45] Date of Patent: Nov. 25, 1986

[54] ELECTRICAL CONNECTOR AND METHOD

[75] Inventor: Vasantrai A. Vachhani, Eden Prairie, Minn.

[73] Assignee: ADC Telecommunications, Minneapolis, Minn.

[21] Appl. No.: 705,902

[22] Filed: Feb. 26, 1985

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 3,950,062 4/1976 Reavis, Jr. ..... 339/97 R 4,283,105 8/1981 Ferril et al. ..... 339/97 R

*Primary Examiner*—Joseph H. McGlynn

*Attorney, Agent, or Firm*—Merchant, Gould, Smith, Edell, Welter & Schmidt

[57] ABSTRACT

An electrical connector primarily designed for use in telecommunications and other applications where quick and reliable wire connections in great magnitude are required is disclosed. The connector has a elongated cylindrical shape with an insulation displacement slot running parallel to its longitudinal axis. It is surrounded by and mounted in a sheltering insulating housing. Adjacent the insulation displacement slot on opposite sides of the conductor are V-shaped or other shaped slots which in combination with the insulation displacement slot, form cantilever beams which act independently of the flexing of the cylinder itself. This creates a modified spring rate in the area where connecting wires are held after they are inserted longitudinally into the insulation displacement slot and moved to a final connection position. Transverse slots on opposite sides of the insulation displacement slot create pairs of independent cantilever beams which are staggered from one another to allow mounting of at least two wires of different cross-sectional diameter.

8 Claims, 14 Drawing Figures

FIG. 1
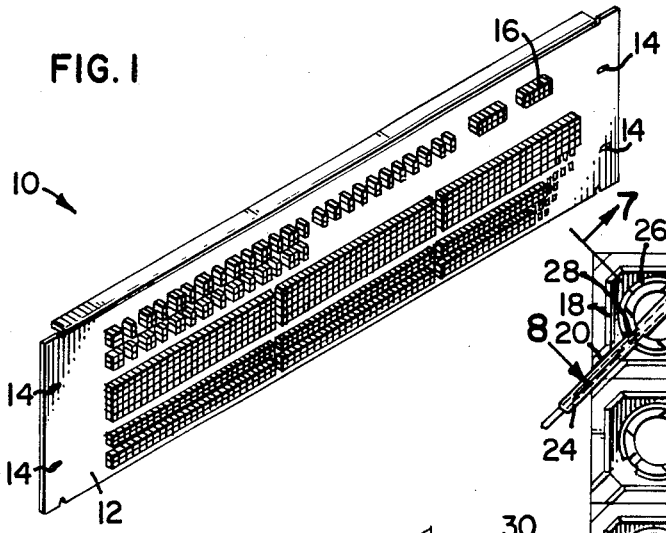
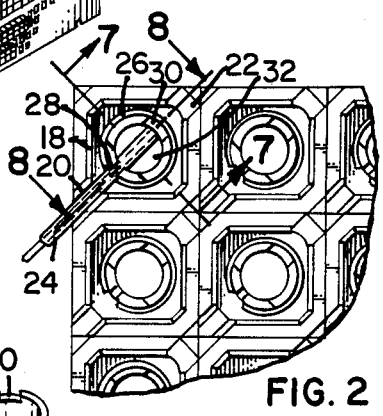
FIG. 2
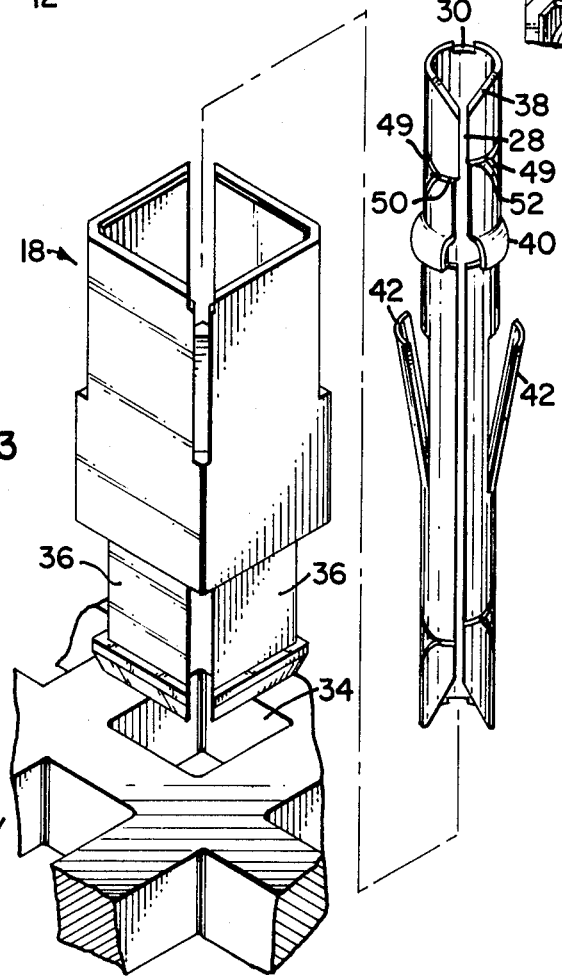
FIG. 3
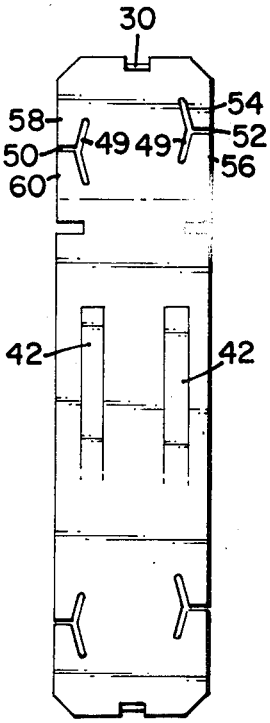
FIG. 4

ELECTRICAL CONNECTOR AND METHOD

TECHNICAL FIELD OF THE INVENTION

The present invention pertains generally to the field of electrical connectors and, more particularly, to electrical connectors for individual insulated wires in which the connection may be made without stripping wires by means of an electrical connector which strips the insulation from a wire end and makes electrical contact in a relatively simple operation. The electrical connector and method of this invention is designed primarily for use in the communications or data transmission industries to provide access to and electrically connect one or more electrical circuits or leads to other circuits or leads.

BACKGROUND OF THE INVENTION

In the communications industry, particularly the telephone industry, there is often a need to electrically connect a relatively large number of circuits or leads with other circuits or leads. This is true both in initial installation of equipment, and as a result of growth, personnel relocation or reassignment, change of telephone numbers, increased sophistication of telecommunications equipment and other factors. As a result, electrical connections between incoming communications leads and outgoing communications leads change on a regular basis.

To allow the frequent circuit changes which are required in this environment, it is conventional to provide circuit access items commonly referred to as connector panels or terminal blocks. These products provide termination of incoming and outgoing leads on one side of the terminal block or panel, while the other side of the terminal block or panel is used to make and change circuit connections between the leads.

On the side used to make and change connections between the leads, various types of electrical connector structures and methods have been used. In some cases, the electrical connector has been a conventional wire wrap pin with the connections between individual pins on the panel being made using a conventional wire wrap or soldering process. These systems have singnificant shortcomings because of the time-consuming and labor-intensive process of making and changing such connections.

As a result of such problems, a system of patch cords and patch plugs was developed for the front faces of panels to access particular circuits or leads merely by plugging in individual patch plugs into jacks mounted on the front of the block or panel. However, such a system was very expensive and required the keeping of a large inventory of different lengths of patch cords for the purpose of making desired connections.

Eventually, connectors were developed which eliminated the need for patch cord systems. These connectors provided a means for directly connecting one end of a connecting wire to a connector element on the front of a panel or block and the other end to a second connector element. Typically, the individual connectors were configured so that, with use of a simple tool, the connector wire could be stripped of insulation to make an electrical contact by means of a tool which forced the connecting wire end through an insulation displacement slot or groove sized to cut through the insulation. The two major types of insulation displacement contacts available which have been commercially successful are split beam and split cylinder contacts. An example of a split cylinder contact is shown in application Ser. No. 650,252 filed on Sept. 13, 1984, which is a continuation of application Ser. No. 321,107 filed on Nov. 13, 1981 and assigned to the assignee of the present application.

The split beam and split cylinder connectors have been a significant improvement over the earlier connectors used in terminal blocks and access panels. However, there has long been a need for improvement in these connectors. First, because of the forces involved, and the relative rigidity of a traditional split cylinder insulation displacement connector element, there tends to be an undesirable force level on the conductor after termination is complete. A relative initial high force is desirable so that the insulation may be severed when the connecting wire is first inserted into the insulation displacement slot of the connector. However, once that process is complete, it is desirable to have a lower force on the wire to maintain the electrical connection. Higher forces in this area tend to increase the risk of wire fatigue and breakage.

In addition, it is desirable to be able to terminate more than one wire, or wires of different gauges, on these contacts. Different installers, or the same installer at different times may use different wire gauges, and a traditional split cylinder connector does not readily handle different wire gauges with adequate connection reliability and performance.

It is also desirable to have an insulation displacement connector which will handle strand-type connector wire without cutting through a high proportion of individual wire strands. This requires a relatively low final connection force between the connector element and the connecting wire.

SUMMARY OF THE INVENTION

The present invention provides a number of advantages over prior insulation displacement connectors described above. It provides a high initial contact force in the insulation displacement slot of the connector to facilitate removal of the connecting wire insulation. However, as the wire moves downward in the insulation displacement slot, the connector is configured to exert a more moderate contact force in the final wire position. This provides better connection reliability and life span of a solid conductor wire and also facilitates use of stranded core connector wire.

This is accomplished by a connector with a generally cylindrical shape which has longitudinal insulation displacement slot running along at least a portion of its length. Spaced longitudinally from the entry end of the cylinder and laterally from the insulation displacement slot are a pair of slots which extend in a generally longitudinal direction. These slots soften the spring force in the area of the insulation displacement slot adajcent to their length.

In certain class of preferrred embodiments of the invention, the split cylinder will have a pair of such slots, one on each side of the insulation displacement slot of the connector. The connector will have transverse cuts running from each side of the insulation displacement slot to an associated softening slot. This will provide a cantilever beam action as well as the traditional cylinder spring action to soften the contact forces in the area in which the beams are active.

In some cases, the transverse slots and softening slots will be longitudinally staggered from one another to facilitate connection of two wires to the connector. These wires may be of different cross-sectional diameter.

These and other important features of the present invention, together with more detailed embodiments which have additional advantages, are described below in more detail in the specification and drawings.

BRIEF DESCRIPTION OF THE DRAWINGS

FIG. 1 is a perspective view of an access panel showing the front face on which interconnections are made to a large number of input and output leads;

FIG. 2 is a plan view of a portion of the access panel shown in FIG. 1, greatly enlarged from the view of FIG. 1, with portions broken away;

FIG. 3 is an exploded perspective view of a single connector assembly of the type shown on the access panel of FIG. 1 constructed according to one embodiment of the present invention;

FIG. 4 is a plan view showing the connector element of FIG. 3 in one stage of manufacture;

DETAILED DESCRIPTION OF THE INVENTION

Figure 5:
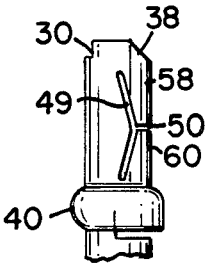
FIG. 5 is a left-hand side elevational view of a portion of the connector shown in FIG. 3.

FIG. 1 shows a termination or access panel 10 in perspective view. The perspective view of Figure 1 shows the front side of a panel with a large number of individual electrical connector assemblies, each of which is used to interconnect input and output leads which may be wired to the connector from the back side of the panel, not shown. Access panel 10 may have a sheet metal base 12 of generally rectangular configuration, with mounting holes 14 at each end to permit the panel to mounted to a wall mount bracket, rack or pair of mounting standards. Groups of individual connector assemblies, for example, such as those labeled with reference numeral 16, protrude outwardly from the access panel on the front side thereof, as shown in FIG. 1. The access panel of FIG. 1 is shown without the connector wires which typically interconnect individual connector elements 16 on the access panel 10.

FIG. 2 shows an enlarged group of individual connector elements 16 in plane view. The connector elements 16 are each a two-piece structure. A first piece is an exterior insulating housing 18. As shown in the plan view of FIG. 2, the insulating housing 18 is generally rectangular in form with clearance apertures 20, 22 at opposed corners to permit wire connection and clearance. In the embodiment shown, clearance aperture 20 may also function as a strain relief by holding the insulation of a connected wire 24. Individual connector wires 24 are connected in a procedure where the wire is first laid across clearance apertures 20, 22, at the same time being laid across the end of cylindrical connector 26. A connecting tool (not shown) is then used to force the wire downward so that its insulation is severed on one side by an insulation displacement slot 28. On the opposite side of cylindrical connector 26 is a cut-off blade 30 which severs the free end of connecting wire 24 when connecting wire 24 is forced down into the cylinder by the connection tool. The connection tool typically has a centered circularly cylindrical post which fits in the interior aperture 32 of connector 26 and a concentric ring sized to fit around the exterior of cylindrical connector 26 to force connector wire 24 downward to perform the combined insulation displacement, wire cut-off, and connection functions.

Figure 7:
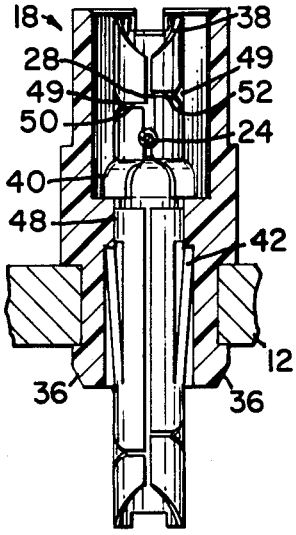
FIG. 7 is a sectional view of the structure of FIG. 2 taken along line 7—7 of FIG. 2.
Figure 8:
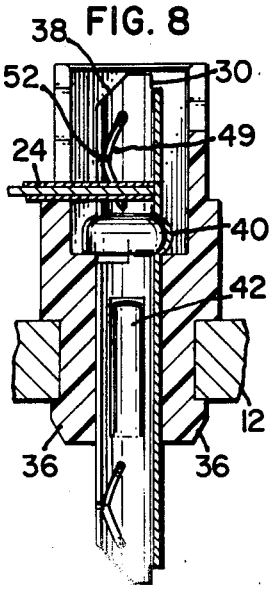
FIG. 8 is a sectional view of the structure shown in FIG. 2 taken along line 8—8 of FIG. 2.

FIG. 3 is an exploded perspective which allows a better view of insulating housing 18, cylindrical connector 26 and the access panel base 12 into which the two-part connector assembly structure 16 is mounted. FIG. 3 shows a generally square panel aperture 34 into which housing 18 is fitted. Housing 18 has a plurality of flexible mounting extensions 36, each of which has a ramp lug for panel mounting. When housing 18 is pressed through aperture 34, extensions 36 flex inward to allow the ramp lugs to pass through the aperture, and spring outward to captivate housing 18 on panel 12 after the lugs have passed through aperture 34. Connector 26 fits into a central longitudinal aperture 36 in housing 18. This is best shown in FIGS. 7 and 8.

As shown in FIG. 3, connector 26 is an elongate circularly cylindrical piece of conductive material, such as brass, phosphor bronze, beryllium copper or other suitable material, which has a lengthwise insulation displacement slot. One way in which the connector 26 may be formed is to begin with a metal blank cut as shown in FIG. 4 and form it to a generally cylindrical shape as shown in FIG. 3.

In the embodiment shown, connector 26 has a tapered entry area 38 opposite cut-off blade 30 which generally guides wire 24 into insulation displacement slot 28. This is accomplished by two tapered surfaces at the end of the cylinder immediately adjacent slot 28. Connector 26 also has a mounting shoulder 40 and mounting tines 42, 42 which cooperate with housing shoulders 44 and 46 of housing 18 to securely mount connector 26 as part of a panel assembly. This is shown in FIGS. 7 and 8. Connector 26 is mounted in housing 18 by first fastening housing 18 in panel base 12 as previously described, then inserting connector 26 downwardly into central aperture 38. As tines 42 move through a neck area 48, they flex inwardly, then spring back so that their ends contact housing shoulders 46. This captivates connector 26 between mounting shoulder 40 and tines 42 about neck 48.

For purposes of making the electrical wire connection, the working area of insulation displacement slot 28 is that above mounting shoulder 40.

Connector 26 has, as a part of that structure, a pair of V-shaped slots 49, 49 spaced from and on opposite sides of insulation displacement slot 28. These slots extend generally longitudinally of connector 26. Each V-shaped slot is oriented with its vertex closest to the displacement slots, and its legs running angularly away from their respective insulation displacement slot surface. In the particular embodiment shown, there are transverse cuts 50 and 52 running from the vertex of V-shaped slots 46, 46 to insulation displacement slot 18. These transverse cuts are small in size by comparison to the width of both insulation displacement slot 28 and V-shaped slots 46. As a result of V-shaped slots 46 and transverse cuts 50, individual cantilever beams 54, 56, 58 and 60 are created. These formed beams lower the overall spring rate of the split cylinder connector along their length by flexing in response to the presence of the conductor of the connector wire when it passes through slot 28 along their length.

As shown in FIGS. 3 and 7, connector 26 may be fabricated with slot 28 staggered at transverse cuts 50 and 52. This permits easier passage of wire from the one cantilever beam to a second beam on one side of slot 28 to permit connection of a second wire to the connector.

This flexing of cantilever beams 54, 56, 58 and 60 provides a lower contact force than the initial contact force in the area of slot 28 immediately adjacent tapered entry area 38. Thus, a wire being connnected to connector 26 initially undergoes a high pinching force near the tapered entry area 38, which permits the structure to slice through or displace insulation as needed to establish good contact. As a tool continues downward to force the connecting wire 24 to a final rest position, the force on the wire decreases because of the cantilever beam action of elements 54, 56, 58 and 60. Because of the independence of each of the cantilever beams 54, 56, 58 and 60 from one another, adjacent sets of beams can accept different cross-sectional diameter connecting wire and provide a stable and reliable connection to each. This is illustrated in FIGS. 9, 10 and 11.

Figure 9:
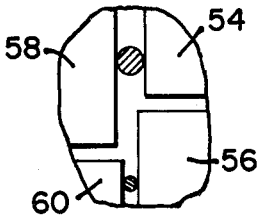
FIGS. 9, 10 and 11 are enlarged front elevational views of the insulation displacement slot of the connector with a cross-section of wires of different gauges being shown to illustrate operation of the present invention in certain preferred embodiments.
Figure 10:
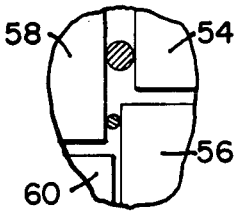
Figure 11:
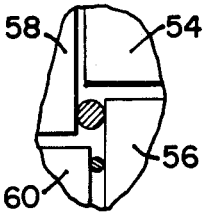

FIGS. 9, 10 and 11 show a cross-section of two different size wires captivated between portions of cantilever beams 54, 56, 58 and 60. In FIG. 9, a first wire is contacted by beams 56, 60; while the second wire is captivated by beams 54, 58. In Figure 10, the first wire is positioned in the area of stagger between cuts 50 and 52, while the second wire is above both cuts. Thus, the smaller wire is contacted by beams 56, 60, while the larger wire is contacted by beams 58, 54. The independence of beams 54 and 56 still allows a reliable contact to be made.

FIG. 11 is the inverse of the contact situation of FIG. 10, with the large wire being contacted between beams 56, 58, while the smaller wire is contacted between beams 56, 60. It will be noted that the staggering of cuts 50, 52 makes this structure relatively insensitive to exact placements of the multiple wires in insulation displacement slot 28, since all of the alternatives as shown in FIGS. 8, 10 and 11 result in stable and reliable connections. While FIGS. 9, 10 and 11 each show contact arrangements in which the smaller gauge wire was connected first, it will be apparent that the connect order could be reversed. For example, in FIG. 9, the larger gauge wire shown in cross-section could have been inserted first, and be located between beams 56 and 60; with the smaller cross-section wire located between beams 54 and 58.

Figure 12:
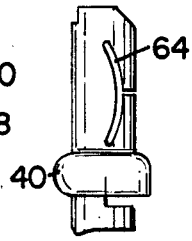

FIG. 12 shows an alterante form for the slots which define cantilever beams opposing one another along the length of insulation displacement slot 28. The shape of the slot 64 in FIG. 12 is parabolic in nature. it will be apparent to persons of skill in theart that the configuration of the beamcreating slots in accordance with this invention could be parabolic, V-shpaed, circular, or any other desired shape which would promote the desired stress distribution characteristics along the length of the beam. The parabolic and V-shapes were selected because they promote a relatively uniform stress distribution, and therefore permit use of less expensive material for fabrication of the connector.

Figure 6:
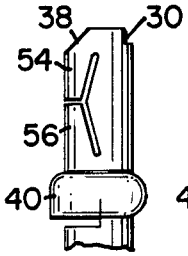
FIG. 6 is a right hand side elevational view of a portion of the connector shown in FIG. 3.
Figure 13:
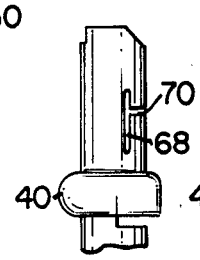
FIGS. 12, 13, and 14 are left side elevational views of alternate embodiments of the present invention in which different forms of cantilever beam are utilized.
Figure 14:
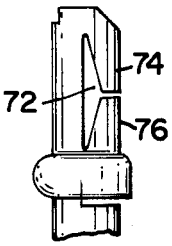

FIGS. 13 and 14 each show further alternate forms for the slots defining the cantilever beams according to the invention. In FIG. 13, a slot 68 formed generally parallel to insulation displacement slot 28 (and connector axis) is shown. Slot 68 is cut by a transverse cut 70 which creates two cantilever beams of unequal length along one side of slot 28. This may be desirable in applications where different forces are desired along the length of slot 28, for example, where wires of differing hardness are to be connected. FIG. 14 shows an alternate embodiment in which a slot 72 isd formed by cutting a generally triangular aperture in the connector. This creates cantilever beams 74 and 76 having characteristics quite similar to those in FIGS. 5 and 6, but lessens the contact force due to the cylindrical spring action of the connector.

In one recently constructed embodiment of the invention, the material used was 0.016 inch thick phosphor bronze, extra hard, alloy 521. The exterior diameter of the connector cylinder was 0.125 inches, and the size of insulation displacement slot was 0.008. The distance between the transverse cuts was 0.045 inches, while the thickness of V-shaped slots was 0.020 inches. The slots were V-shaped with a 14 degree angle with respect to the insulation displacement slot when viewed in side elevation, and a vertical height of 0.150 inches. With such dimensions, this structure was tested and very successful for connection for sizes 22, 24 and 26 gauge wire. Although phosphor bronze was used for this example, other copper alloys, e.g. beryllium copper, might be used in certain preferred embodiments.

In accomplishing two wire connection using this invention, an operator would first utilize a tool capable of forcing the first wire deep enough to reach at least past the first transverse cut of the connector involved. The second wire can then be inserted to a higher point so that it contacts only the two upper beams. Alternatively, the stagger between the transverse cuts can be chosen to have a relationship to the size of the largest diameter wire such that if the largest diameter wire occupies the position between the transverse cuts, the other wire connected cannot.

Although the present invention has been described above in a preferred form, those skilled in the art will readily appreciate that various modifications may be made to it without departing from the spirit and scope of the invention, as bounded only by the claims of the application itself. Merely as an example, and not by way of limitation, the precise shape and form of relief which creates the original cantilever beams could take any one of a number of configurations.

What is claimed is:

1. An insulation displacement connector, comprising:

(a) an elongated conductive element, the element having a generally circular cross-section;

(b) an open seam extending along the length of the element, the seam having a width sized to accept a conductor of predetermined cross-sectional range;

(c) a pair of slots, each of the slots extending generally parallel to the seam, each slot spaced inward from the seam on opposite sides thereof; and, (d) first and second cuts in the element generally extending about segments of its circumference, each cut extending between an associated slot and the seam, with the first and second cuts displaced from one another along the length of the element such that pairs of opposed, staggered beam segments are formed, each being active along a different portion of the cylinder length.

2. The structure of claim 1 wherein the slots are generally V-shaped, with each of the first and second cuts extending approximately from the vertex of an associated one of the V-shaped slots to the open seam.

3. The structure of claim 1 wherein the cuts are made generally transverse to the cylinder axis.

4. The structure of claim 1 wherein the apertures are positioned such that each cut intersects its associated slot to create two approximately equal length cantilever beam structures.

5. The structure of claim 1 wherein the vertex of each of said V-shaped apertures is closer to said slot than the ends of the legs of the V, and transverse cuts join the vertices and the slot.

6. The structure of claim 1 wherein the longitudinal displacement between the first and second cuts is such that if the largest diameter wire to be used with the connector is placed between the cuts, there is insufficient remaining space for a second wire to be placed between the cuts.

7. A method of fastening first and second insulated wires to a split cylinder connector having at least three overlapping cantilever beam segments opposed in staggered pairs along an insualted displacement slot thereof, comprising the steps of:

(a) inserting the first wire oriented transverse to said slot into said slot along a first portion thereof where no beam segment is present to displace insulation therefrom;

(b) moving the first wire along the slot past the first portion to a portion along an overlap between a first pair of said beam segments;

(c) inserting the second wire oriented transverse to said slot along said first portion to displace insulating therefrom; and (d) moving the second wire to the position occupied by the first wire, thereby displacing the first wire and establishing contact between each wire and a distinct separate staggered pair of segments of said connector.

8. The method of claim 7 wherein a tool is used to insert the first and second wires, the staggered beam segments are defined by at least two transverse cuts staggered from one another along the length of the insulation displacement slot, and the step of moving the second wire includes the substep of using the tool to push the first wire past at least one of the transverse cuts.

* * * * *